United States Patent [19]

Mahajan et al.

[11] Patent Number: 4,787,943

[45] Date of Patent: Nov. 29, 1988

[54] DISPERSION STRENGTHENED ALUMINUM-BASE ALLOY

[75] Inventors: Yashwant R. Mahajan, Kanchanbagh, India; Susan D. Kirchoff, Dayton; Francis H. Froes, Xenia, both of Ohio

[73] Assignee: The United States of America as represented by the Secretary of the Air Force, Washington, D.C.

[21] Appl. No.: 45,970

[22] Filed: Apr. 30, 1987

[51] Int. Cl.[4] ..... C22C 21/00

[52] U.S. Cl. ..... 148/437; 420/551; 420/552

[58] Field of Search ..... 420/551, 552; 148/415, 148/437

[56] References Cited

U.S. PATENT DOCUMENTS

| | | | |
|---|---|---|---|
| 3,278,300 | 10/1966 | Koike | 75/138 |
| 3,388,050 | 6/1968 | Wainer | 204/58 |
| 3,876,474 | 4/1975 | Watts et al. | 148/32 |
| 3,909,247 | 9/1975 | Paris et al. | 75/84.1 R |
| 4,213,799 | 7/1980 | Raghavan et al. | 148/2 |
| 4,213,800 | 7/1980 | Mayo et al. | 148/2 |
| 4,379,719 | 4/1983 | Hildeman et al. | 419/60 |
| 4,464,199 | 8/1984 | Hildeman et al. | 75/249 |
| 4,624,705 | 11/1986 | Jatkar et al. | 75/239 |

OTHER PUBLICATIONS

Y. R. Mahajan, S. D. Kirchoff, and F. H. Froes, "Thermal Stability of Rapidly Solidified Al—Ti—Gd Alloy", Scripta Metallurgica, vol. 20, pp. 643-647, May 1986.

*Primary Examiner*—R. Dean

*Attorney, Agent, or Firm*—Charles E. Bricker; Donald J. Singer

[57] ABSTRACT

An aluminum alloy containing about 2 to 6 weight percent titanium, about 3 to 11 weight percent of a rare earth of the Lanthanide Series and up to about 3 weight percent of at least one Group VIII metal, balance aluminum, is disclosed. The alloy is preferably prepared by rapid solidification in powder, particulate or ribbon form, and is subsequently compacted under controlled conditions.

6 Claims, 5 Drawing Sheets

DISPERSION STRENGTHENED ALUMINUM-BASE ALLOY

RIGHTS OF THE GOVERNMENT

The invention described herein may be manufactured and used by or for the Government of the United States for all governmental purposes without the payment of any royalty.

BACKGROUND OF THE INVENTION

This invention relates to an aluminum alloy. In particular, this invention relates to a dispersion strengthened aluminum alloy.

Aluminum alloys have been widely used in applications such as aircraft because of their relatively low cost, ease of fabrication and attractive mechanical properties. Various efforts have been made to further improve the strength of aluminum alloys, including the use of aluminum powder-derived alloy products wherein aluminum powder is produced, compacted and shaped into a useful article.

Conventional aluminum alloys lose their strength above about 150° C. because strengthening precipitates coarsen rapidly and lose coherency. Powder metallurgy offers a means of dispersing intermetallic phases that resist coarsening, and provide significant strength up to about 350° C. The approach generally is to add alloying additions, such as the transition metals or rare earth metals, with low solubility and low diffusion rates. Additionally, oxide, carbide, and intermetallic dispersion strengthening introduced by mechanical attrition provide strength at elevated temperatures and excellent room temperature strength after prolonged elevated temperature exposure.

Alloys developed by mechanical attrition have shown attractive stress-rupture properties, as well as excellent elevated-temperature stability. However, strength in the 230°–345° C. range has not been as high as that obtained by rapid solidifcation.

Rapidly solidified material is produced by rapidly quenching molten aluminum alloys which results in a fine dispersion of intermetallic particles for strengthening compacts formed by squeezing or compacting such aluminum powders, ribbons or particulates.

In general, there are two types of aluminum alloys strengthened with second phase particles. In heat treatable alloys, fine intermetallic particles, referred to as precipitates result in products with high strength and toughness. These are produced by solid-state heat treatment involving solutionizing the second phase particles, followed by quenching and aging steps to provide the desired fine distribution of second phase precipitates. On the other hand, non-heat treatable dispersion strengthened aluminum alloys rely on the production of fine incoherent intermetallics to strengthen the aluminum matrix by impeding dislocation motion (plastic flow) due to their close spacing. In this case, the second phase particles have little or no solubility in the solid state even at high temperatures. Thus, once produced, they are very thermally stable. They cannot be refined by solid state processing; they can only be refined by returning to the liquid state followed by rapid solidification. In this alloy class, it is extremely critical to carefully select alloy composition so a fine, thermally stable dispersoid is produced, since once a coarse distribution occurs, there is no solid-state heat treatment to refine the distribution as in the case of precipitation hardened systems. In both alloy types it is desirable to maintain the dispersoid and intermetallic particles in a fine size and spacing to achieve good combination of strength and toughness. Various alloy refinements and process refinements have gone forward in order to further the property gain achieved in the dispersion hardened alloys and there is a continuing desire to further improve the strength of compacted aluminum products produced therefrom.

U.S. Pat. No. 4,464,199 to Hildeman and Sanders, discloses aluminum-iron-rare earth metal alloys which exhibit significant improvement in yield strength over ingot material such as 2219--T852. Another promising inroad involves aluminum-titanium-rare earth metal alloys and the present invention concerns these alloys.

It is an object of the present invention to provide a novel aluminum alloy.

Other objects, aspects and advantages of the invention will be apparent to those skilled in the art.

SUMMARY OF THE INVENTION

Figure 1:
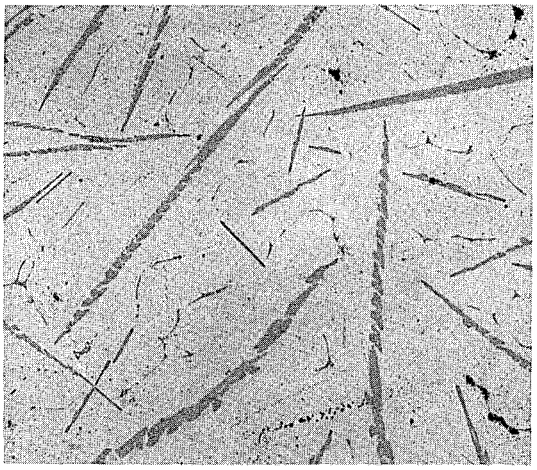
FIGS. 1 and 2 are 200 X microphotographs showing the microstructure of arc-melted Al-4Ti and Al-4Ti-4Gd alloy buttons, respectively.

In accordance with the present invention there is provided an alloy comprising 2 to 6 weight percent titanium and 3 to 11 weight percent of at least one rare earth metal, balance aluminum. The term rare earth metal refers to the lanthanide series from Period 6 of the Periodic Table, with gadolinium being preferred. The titanium content should be such that the maximum atomic ratio of titanium to rare earth metal is 2:1. In addition to aluminum, titanium and gadolinium or other rare earth metal, the alloys of this invention can contain up to 3 weight percent of at least one Group VIII metal, preferably iron. The function of these metal additions is to improve strength at high temperatures, and to be effective for such purpose the additions are preferably 0.1 weight percent or more.

Since the alloy of this invention may contain both iron and cerium, a mixture of rare earth elements (atomic numbers 57–71) typically containing about 50 weight percent cerium, with lesser amounts of lanthanum, neodymium, praseodymium and other rare earths, commonly known as misch metal, is an economical and pratical source for cerium. The normal impurities of 0.1% in misch metal of iron and magnesium are acceptable.

The alloys are produced in powder, particulate or ribbon form from a well-mixed superheated molten alloy using techniques known in the art which are capable of achieving rapid quenching.

The rapidly solidified material is then compacted at high temperature in a vacuum. Prior to vacuum high temperature compaction, the material may be isostatically compressed at room temperature into a cohesive or coherent shape using known techniques. With or without preliminary isostatic compaction, the material is compacted at substantially full density at relatively high temperatures. This can be effected by placing the material or the isostatically compacted material in a container and evacuating the container at room temperature and heating to a temperature of about 350° C. to 425° C., while continuing to pull a vacuum down to a pressure of one torr or less. While still in the sealed container, the material is compressed to substantially full density at a temperature of about 35020 to 500° C. When referring to substantially full density, it is intended that the compacted billet or item be substantially free of porosity with a density equal to 95% or more of theoretical solid density, preferably 98% or more.

After being compacted to substantially full density at elevated temperature and vacuum conditions, as described above, the container maybe removed from the compact which can then be shaped such as by forging, rolling, extruding or the like, or can be machined into a final shape.

The following example illustrates the invention:

EXAMPLE

Small buttons of Al-4Ti, Al-4Ti-4Gd and Al-8Fe-4Ce (weight percent) were prepared by non-consumable arc melting. Melt spun ribbons were produced by induction melting the alloy in a quartz crucible and ejecting the liquid metal through a nozzle using pressurized argon gas onto a rotating water-cooled copper wheel (surface velocity, 20 m/s). The typical ribbon thickness was about 75 microns. Ribbons were annealed at temperature between 100° and 600° C. for 1 hour to determine the thermal stability of each alloy.

Samples of the as-arc-melted buttons and as-rapidly-solidified and heat-treated ribbons were characterized using optical microscopy, scanning electron microscopy (SEM), and analytical electron microscopy (STEM/TEM) techniques. Microhardness (knoop) measurements were made for all conditions on polished and lightly etched longitudinal sections using a 10 g load for 15 seconds. A minimum of 25 indentations were made for each condition.

Figure 2:
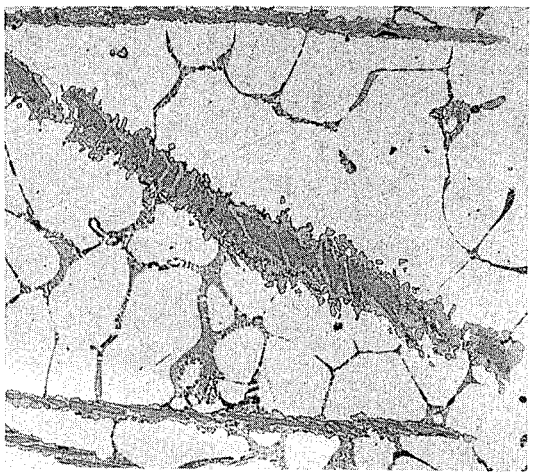

The microstructures of Al-4Ti and Al-4Ti-4Gd arc-melted alloy buttons are shown in FIGS. 1 and 2, respectively. Referring to FIG. 1, the Al-4Ti microstructure consists of $Al_3Ti$ needles in a matrix of alpha-Al grains. Referring to FIG. 2, the addition of Gd to the Al-4Ti binary alloy results in $Al_3Ti$ needles which are surrounded by Al-Ti-Gd type intermetallic compound. The needles act as nucleation sites to form alpha-Al equiaxed dendrites. The last solute rich interdendritic liquid was solidified by eutectic reaction. The eutectic microstructure consists of Al and $Al_3Gd$.

Figure 3:
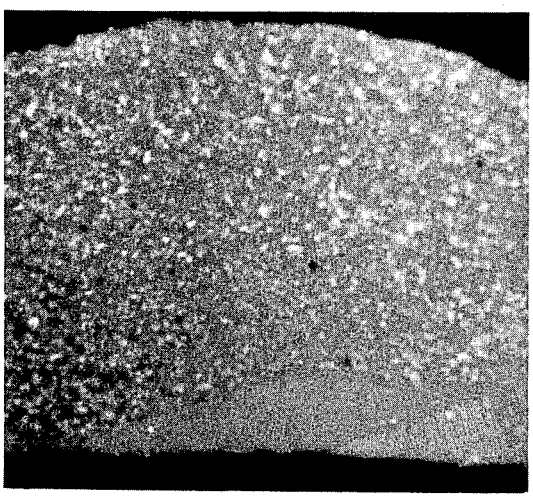
FIGS. 3 and 4 are 1000 X microphotographs of longitudinal cross sections of as-melt-spun Al-4Ti and Al-4Ti-4Gd alloy ribbons, respectively.
Figure 4:
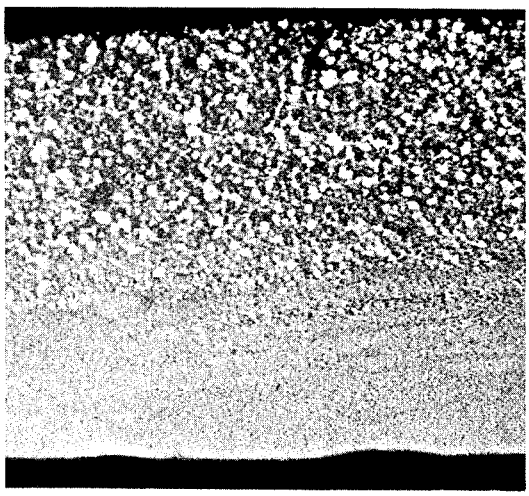

The SEM microstructures (longitudinal cross sections) of Al-4Ti and Al-4Ti-4Gd as-melt-spun alloy ribbons are shown in FIGS. 3 and 4, respectively. Referring to FIG. 3, the Al-4Ti alloy microstructure consists of fine and coarse regions corresponding to wheel-side and air-side of the ribbon. The coarse region shows the presence of acicular-shaped compound. Referring to FIG. 4, it can be seen that a typical chill zone of the Al-4Ti-4Gd alloy consists of fine precipitates and the slowly-cooled region exhibits coarse microstructure.

Figure 7:
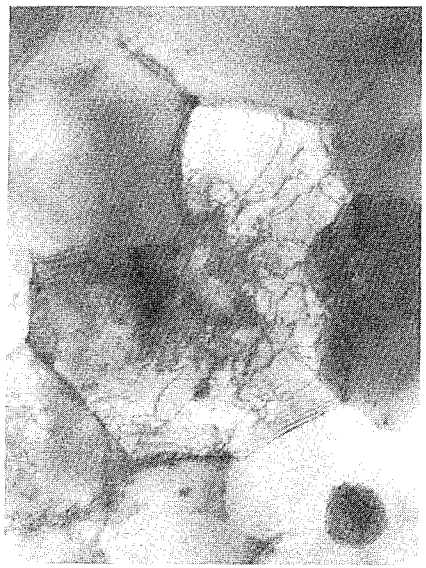
FIGS. 5–7 are 33000 X, 20000 X and 33000 X microphotographs, respectively, showing the microstructure of as-melt-spun Al-4Ti alloy ribbon.
Figure 6:
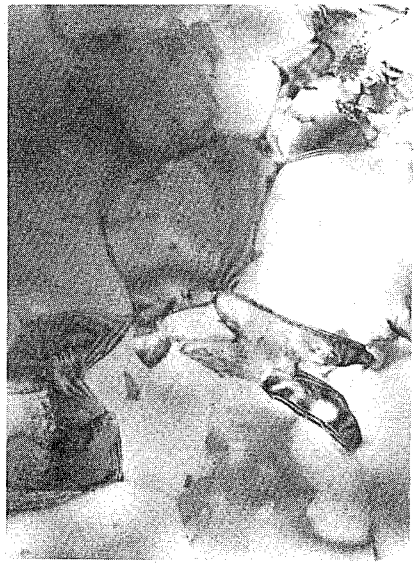
Figure 5:
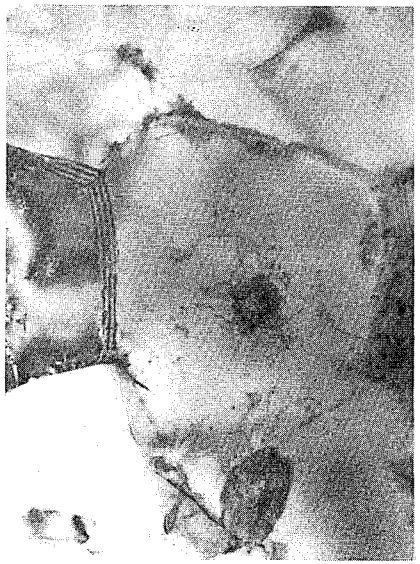

The TEM microstructure of Al-4Ti as-melt-spun alloy is shown in FIGS. 5–7. FIG. 5 shows a rosette shaped $Al_3Ti$ particle which appears as a nucleation site for a surrounding alpha-Al grain. FIG. 6 shows a large H-shaped $Al_3Ti$ compound. It can be seen in FIG. 7 that some regions of the Al-4Ti alloy ribbons show extremely fine $Al_3Ti$ type precipitates. It is of interest to note that large areas of the alloy are completely free of any kind of precipitates (FIG. 5 and 6).

Figure 8:
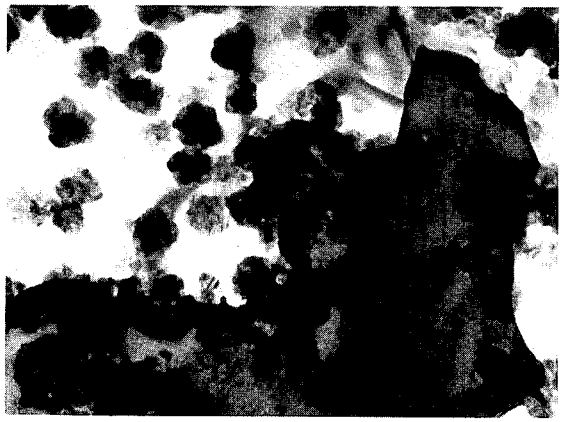
FIGS. 8 and 9 are 20000X and 66000X microphotographs, respectively, showing the microstructure of as-melt-spun Al-4Ti-4Gd alloy ribbon.
Figure 9:
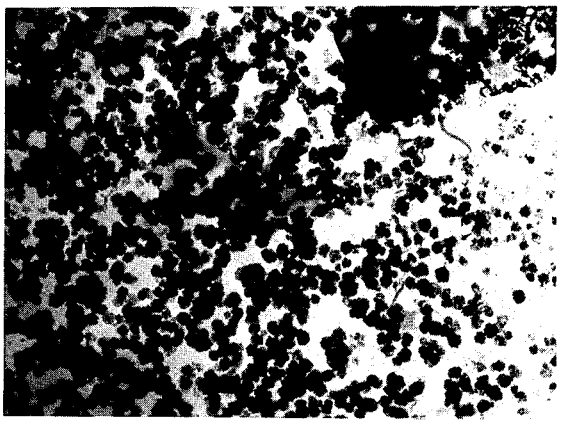

The TEM microstructure of Al-4Ti-4Gd as-melt-spun alloy is shown in FIGS. 8 and 9. The microstructure consists of Al-Ti-Gd ternary compound dispersoids distributed uniformly throughout the matrix. The presence of ternary compound was confirmed by STEM and X-ray diffraction analysis. Each precipitate actually consists of an aggregate of very fine particles as shown in FIG. 9. The hardness for the fine microstructure of FIG. 9 is 125 kg/mm$^2$ and for the coarse microstructure is 110 kg/mm$^2$. This suggests that although the overall size of precipitates in the slowly cooled region is large (0.2–3.0 $\mu$m) because of their unique microcrystalline nature, the precipitates still act as strengtheners.

Figure 10:
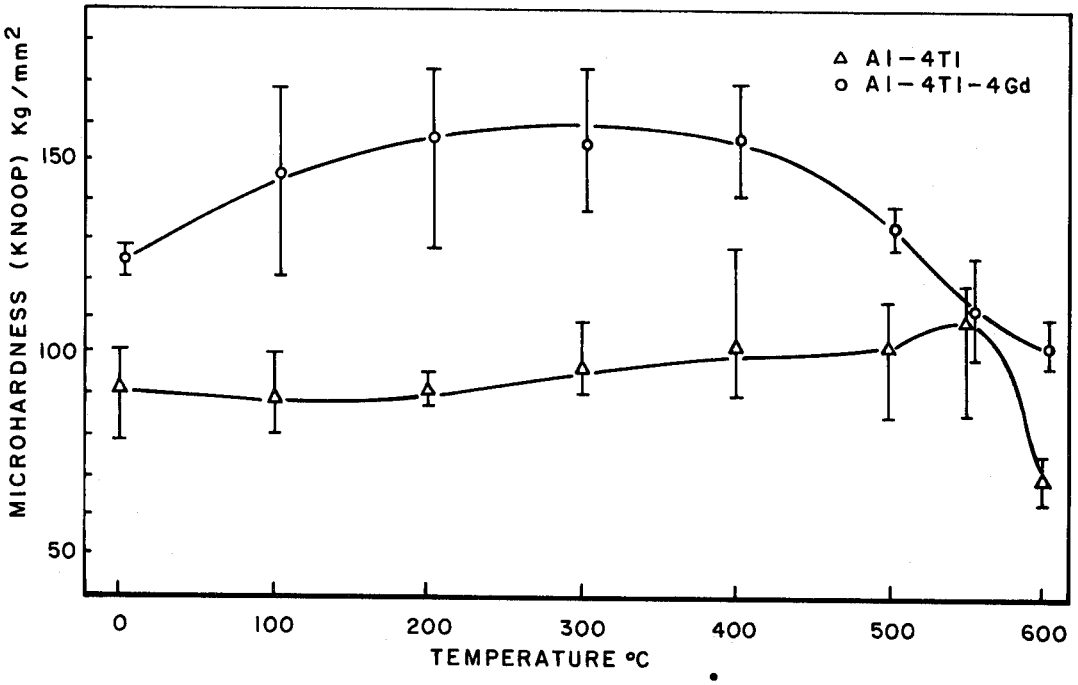
FIG. 10 is a graph illustrating the isochronal annealing response of Al-4Ti vs. Al-4Ti-4Gd.

The isochronal annealing response of Al-4Ti and Al-4Ti-4Gd alloys was determined by making microhardness measurements after exposure to temperature for 1 hour. The Knoop hardness number versus isochronal annealing temperature for Al-4Ti and Al-4Ti-4Gd alloys is plotted in FIG. 10. The Al-4Ti-4Gd alloy shows a higher hardness level as compared to the Al-4Ti alloy over the entire temperature range. Moreover, the former also retains the high hardness level i.e., 100 kg/mm$^2$ up to 600° C., as compared to the hardness of 125 kg/mm$^2$ for the initial as-melt-spun ribbon.

Figure 11:
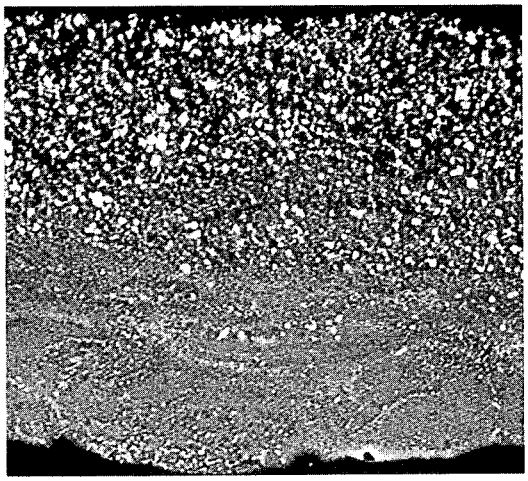
FIG. 11 is a 1000X microphotograph illustrating the microstructure of Al-4Ti-4Gd alloy ribbon following annealing at 600° C. for 1 hour.

The SEM microstructure of Al-4Ti-4Gd following annealing at 600° C. for 1 hour is shown in FIG. 11. Comparison of FIG. 4 with FIG. 11 reveals that coarsening of the precipitates is almost negligible.

Figure 12:
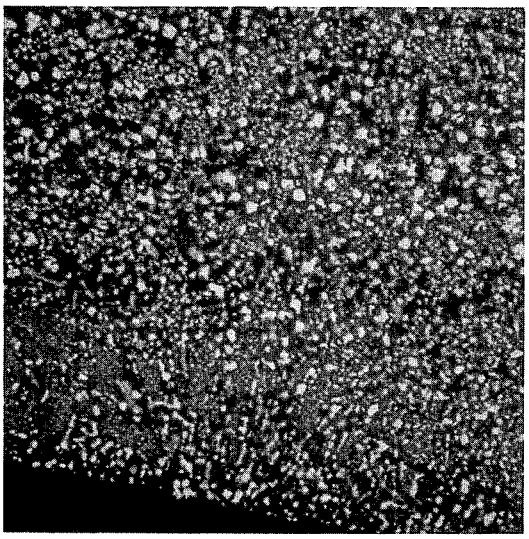
FIGS. 12 and 13 are 3000X and 2000X microphotographs showing the microstructure of Al-4Ti-4Gd and Al-8Fe-4Ce alloy ribbons, respectively, following annealing at 600° C. for 1 hour.
Figure 13:
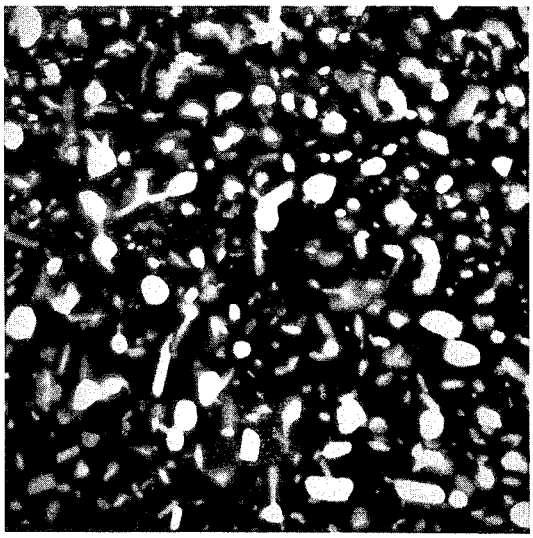

The SEM microstructures of Al-4Ti-4Gd and Al-8Fe-4Ce following annealing at 600° C. for 1 hour are shown in FIGS. 12 and 13, respectively. Referring to FIG. 12, the microstructure of Al-4Ti-4Gd alloy exhibits fine globular shaped precipitates. In contrast, as shown in FIG. 13, heat treatment resulted in formation of needle-shaped $Al_3Fe$ compound.

Figure 14:
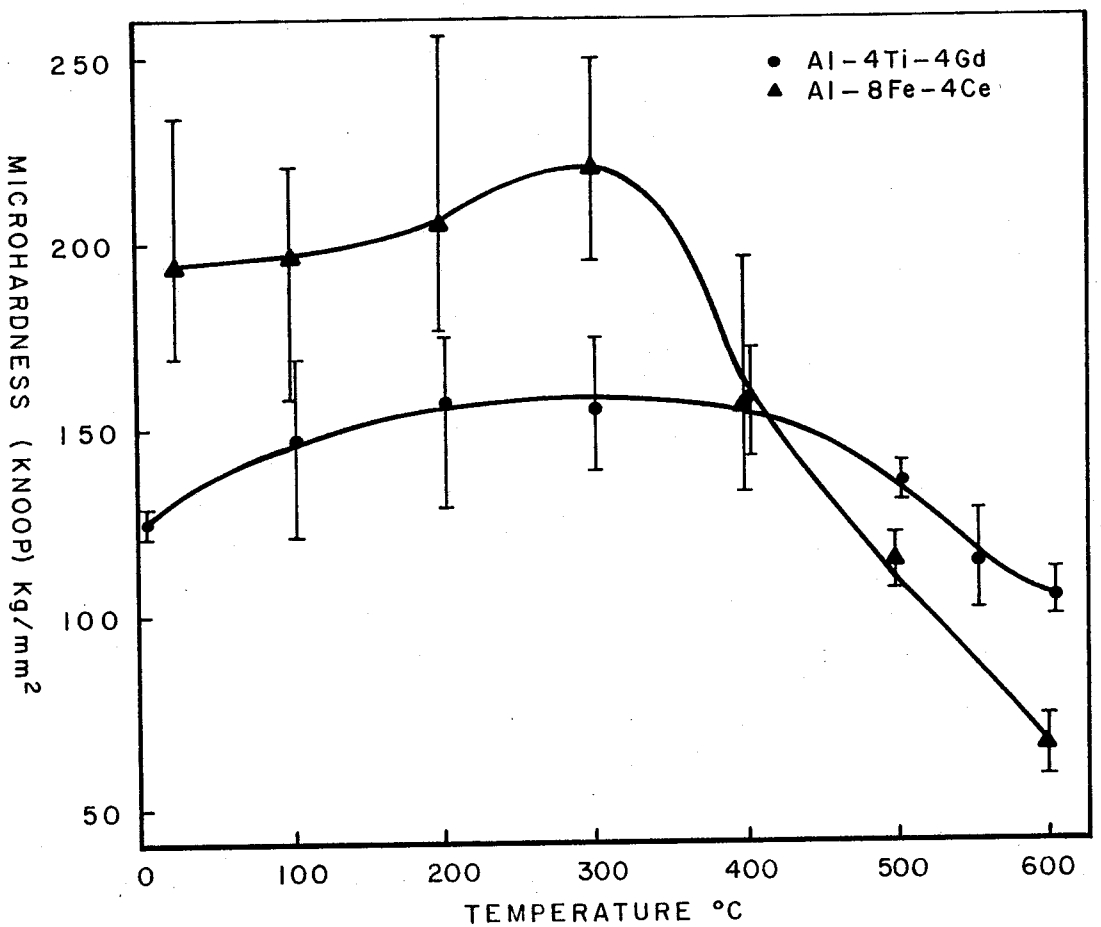
FIG. 14 is a graph illustrating the isochronal annealing response of Al-4Ti-4Gd vs. Al-8Fe-4Ce.

The isochronal annealing response of Al-8Fe-4Ce was determined by making microhardness measurements after exposure to temperature for 1 hour. The Knoop hardness number versus isochronal annealing temperature for Al-8Fe-4Ce and Al-4Ti-4Gd alloys is plotted in FIG. 14. The Al-4Ti-4Gd alloy shows a high hardness level up to 600° C. This alloy exhibits higher hardness levels for temperatures of 400–600° C. as compared to the Al-8Fe-4Ce alloy.

The homogeneity of microstructure of as-rapidly-solidified Al-4Ti-4Gd ribbon was assessed by comparing the microhardness of the slowly cooled side versus that of the chilled side. The results were 110 kg/mm$^2$ (slowly cooled) versus 125 kg/mm$^2$ (chilled). In contrast the Al-8Fe-4Ce ribbon had results of 100 kg/mm$^2$ (slowly cooled) versus 192 kg/mm$^2$ (chilled). These results clearly indicate the homogeneous nature of the Al-4Ti-4Gd alloy ribbons.

Various modifications may be made without departing from the spirit of the invention or the scope of the appended claims.

We claim:

1. An aluminum alloy dispersion strengthened with at least one rare earth metal consisting essentially of about 2 to 6 weight percent titanium, about 3 to 11 weight percent of at least one rare earth of the Lanthanide Series and up to about 3 weight percent of at least one Group VIII element, balance aluminum.

2. The alloy of claim 1 wherein the maximum atomic ratio of titanium to rare earth is about 2:1.

3. The alloy of claim 1 containing about 0.1 to 3.0 weight percent of said Group VIII element.

4. The alloy of claim 1 wherein said Group VIII element is iron.

5. The alloy of claim 1 wherein said rare earth is gadolinium.

6. The alloy of claim 1 having the approximate composition Al-4Ti-4Gd.

* * * * *

UNITED STATES PATENT AND TRADEMARK OFFICE

CERTIFICATE OF CORRECTION

PATENT NO. : 4,787,943

DATED : November 29, 1988

INVENTOR(S) : Yashwant R. Mahajan et al

It is certified that error appears in the above-identified patent and that said Letters Patent is hereby corrected as shown below:

Col 3, line 23, replace "35020" with --350°--.

Signed and Sealed this

Ninth Day of May, 1989

*Attest:*

DONALD J. QUIGG

*Attesting Officer*

*Commissioner of Patents and Trademarks*